US006601661B2

(12) United States Patent
Baker et al.

(10) Patent No.: US 6,601,661 B2
(45) Date of Patent: Aug. 5, 2003

(54) SECONDARY CUTTING STRUCTURE

(75) Inventors: Brian Andrew Baker, Spring, TX (US); Brian Andrew Wiesner, Edmond, OK (US); Rudolf Carl Otto Pessier, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/953,834

(22) Filed: Sep. 17, 2001

(65) Prior Publication Data

US 2003/0051922 A1 Mar. 20, 2003

(51) Int. Cl.[7] ..... E21B 10/16

(52) U.S. Cl. ..... 175/341; 175/336; 175/374; 175/378

(58) Field of Search ..... 175/327, 331, 175/336, 341, 374, 377, 378

(56) References Cited

U.S. PATENT DOCUMENTS

| | | | |
|---|---|---|---|
| 3,952,815 A | | 4/1976 | Dysart |
| 4,202,419 A | | 5/1980 | Youngblood |
| 4,716,977 A | * | 1/1988 | Huffstutler |
| 4,940,099 A | | 7/1990 | Deane et al. |
| 4,991,670 A | | 2/1991 | Fuller et al. |
| 5,709,278 A | * | 1/1998 | Crawford |
| 6,176,329 B1 | | 1/2001 | Portwood et al. |
| 6,408,958 B1 | | 6/2002 | Isbell et al. |

FOREIGN PATENT DOCUMENTS

| | | |
|---|---|---|
| EP | 1182326 A2 | 2/2002 |
| GB | 2317195 A | 3/1998 |

* cited by examiner

*Primary Examiner*—Roger Schoeppel
(74) *Attorney, Agent, or Firm*—Bracewell & Patterson, L.L.P.

(57) ABSTRACT

A three cone roller bit with rolling cone cutters that are provided with both primary and secondary cutting elements. The primary cutting elements extend outwardly from lands on the outer surface of the cutter body. The secondary cutting elements are disposed within grooves on the cutter body so as to either protrude with its cutting surface from the bottom of the groove or be flush or slightly recessed within it. During normal operation, the primary cutter elements of the rolling cone cutters engage the borehole formation. The secondary cutters do not engage the formation. After substantial wear has occurred to the primary cutter elements, and wear begins to occur to the body of the cone cutters, the secondary cutter elements serve as a secondary cutting structure that engages and cuts into the formation.

14 Claims, 2 Drawing Sheets

Fig. 2
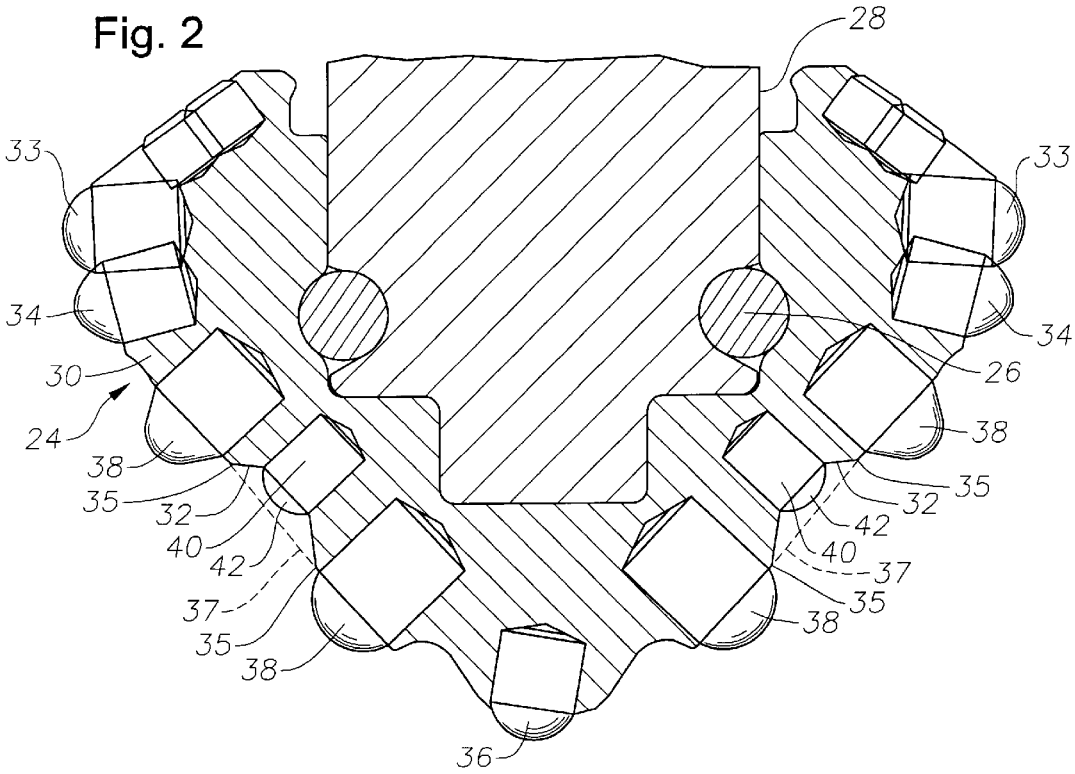
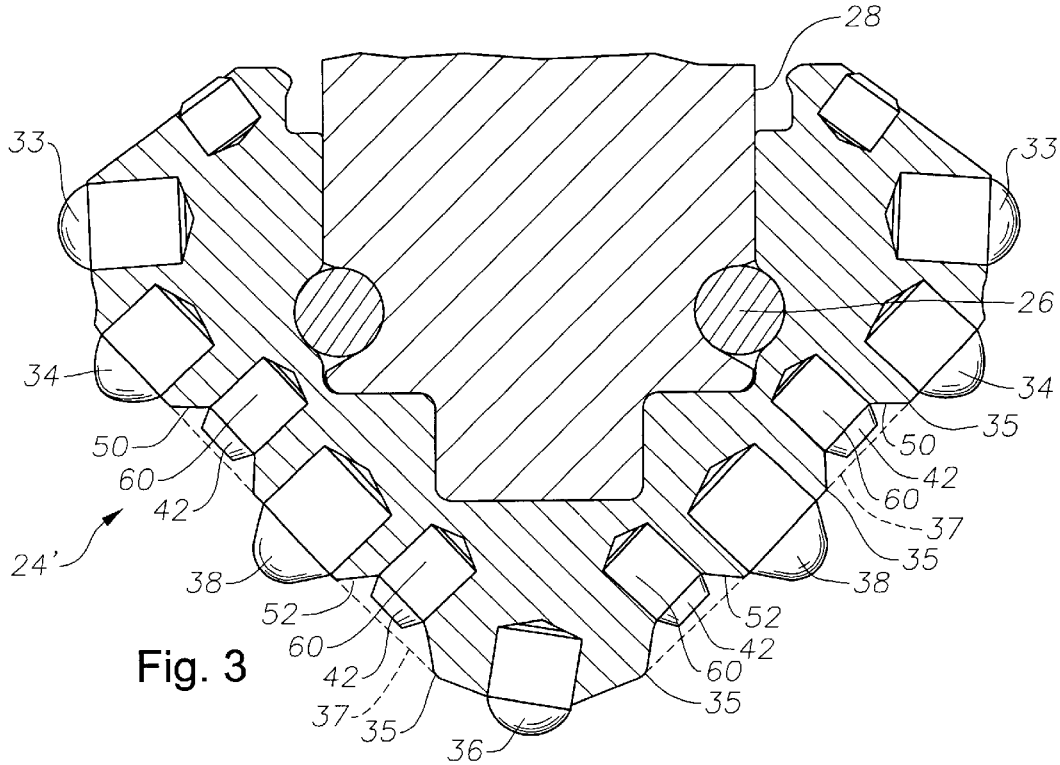
Fig. 3

SECONDARY CUTTING STRUCTURE

BACKGROUND OF THE INVENTION

1. Field of the Invention

The invention relates generally to bit used for drilling hydrocarbon wells and, in particular aspects, the invention relates to three cone roller bits.

2. Description of the Related Art

When drilling hard and abrasive formations, the life of a drill bit is frequently limited by the wear rate of the tungsten carbide inserts and the cone steel. A shorter bit life translates directly into higher well drilling costs. When a bit become worn and loses its ability to effectively cut through formation, the entire drill string must be removed in order to replace the bit. This requires a substantial amount of time and effort.

The present invention addresses the problems associated with the prior art.

SUMMARY OF THE INVENTION

An improved bit is described as well as a method for improving the drilling life of the bit. An exemplary three cone roller bit is described having rolling cone cutters that are provided with both primary and secondary cutting elements. The primary cutting elements extend outwardly from the raised outer surfaces, or lands, of the cutter body. The secondary cutting elements are disposed within the grooves on the cutter body.

At the beginning of normal drilling operation, the primary cutting elements of the rolling cone cutters engage the borehole formation. The secondary cutting elements do not engage the formation. After substantial wear and breakage has occurred on the primary cutting elements, and wear begins to occur on the lands on the cutter body, the secondary cutting elements become active and serve as a secondary cutting structure that engages and cuts into the formation.

BRIEF DESCRIPTION OF THE DRAWINGS

FIG. 2 is a cross-section of one exemplary rolling cone cutter used within the bit shown in FIG. 1.

FIG. 3 is a cross-sectional view of an alternative rolling cone cutter.

DETAILED DESCRIPTION OF THE PREFERRED EMBODIMENTS

Figure 1:
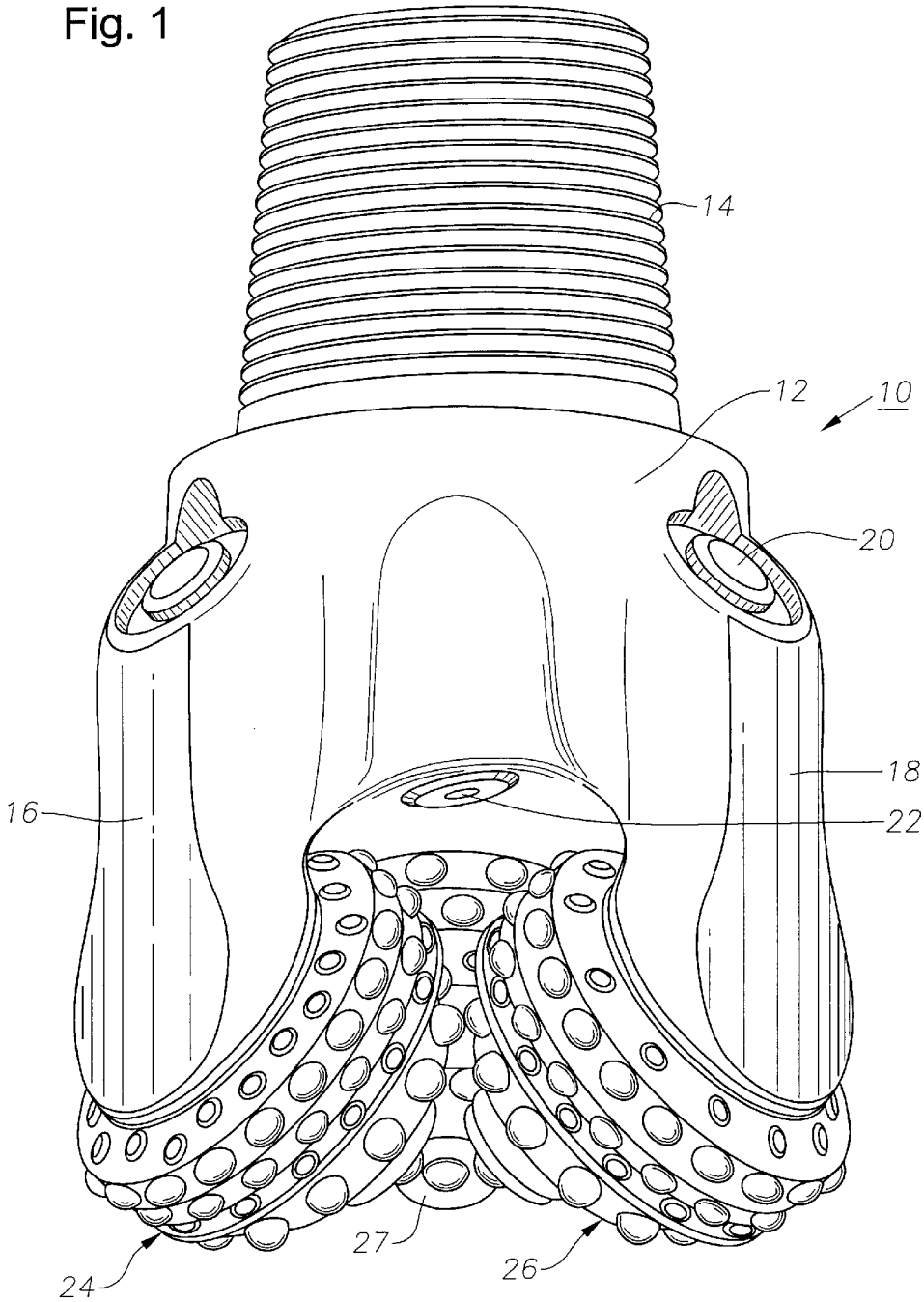
FIG. 1 is an overall isometric view of an exemplary three cone roller bit constructed in accordance with the present invention.

FIG. 1 illustrates an earth boring bit 10 of the well-known three cone roller bit variety. The bit 10 includes a bit body 12 having a threaded pin-type connector 14 at its upper end for incorporation of the bit body 12 into the lower end of a drill string (not shown). The bit body 12 has three downwardly depending legs (two shown at 16, 18) with a lubricant compensator 20 provided for each. Nozzles 22 (one shown) are positioned between each of the adjacent legs to dispense drilling fluid during drilling. The drilling fluid is pumped down through the drill string and into a cavity (not shown) in the bit body 12. A rolling cone cutter is secured to the lower end of each of the three legs. The three rolling cone cutters 24, 26 and 27 are visible in FIG. 1 secured in a rolling relation to the lower ends of the legs of bit body 12.

An exemplary embodiment of one rolling cone cutter 24 is depicted in cross section in FIG. 2. It will be understood that the construction would be similar for each of the other two cutters 26 and 27. As shown, the cutter 24 is rotatably retained by bearings 26 on an axle 28. The cutter 24 has a cutter body 30 that is typically formed of a suitably hardened steel. The cutter body 30 is substantially cone-shaped and has a groove 32 disposed within. As FIG. 2 shows, the groove 32 is recessed below the angled outermost surface, or lands, 35 of the cutter body 30. The dashed line 37 illustrates the elevation above the groove 32 that is provided by the lands 35 on either side.

A plurality of primary cutting elements 33, 34, 36, 38 extend from the cutter body 30 and, when the cutter body 30 is rotated upon the axle 28, the primary cutting elements engage earth within a borehole and crush it. The primary cutting elements are those cutting elements that are brought into cutting contact with portions of the borehole during normal use of the bit 10. The primary cutting elements are arranged into various cutting rows. Heel row cutting elements 33 are located along the outermost edge of the cutter body 30. Adjacent heel row cutting elements 34 are located next to the heel row elements 33. A nose insert 36 is disposed within the tip of the cutter body 30. Inner rows of inserts 38 are disposed between the adjacent heel row inserts 34 and the nose insert 36. The cutting elements 33, 34, 36 and 38 are typically formed of tungsten carbide, but inserts made of other materials may be used.

A row of secondary cutter inserts 40 is disposed within the bottom surface of groove 32. Inserts 40 are also contained within the groove 32 and do not protrude beyond the outer surface of the cutter body 30. More specifically, the inserts 40 do not protrude beyond the elevation 37 that is formed by drawing a line between the adjacent lands 35 of the cutter body 30. In an alternative embodiment, the secondary cutter inserts 40 are substantially flush with the bottom 42 of groove 32. Because the secondary cutter inserts 40 are either flush with or fully contained within the groove 32, they are not brought into cutting contact with the borehole during normal operation of the drill bit 10. One exception is offcenter running, which is characterized by the grooves on all three cones lining up during rotation. This leaves ridges on the borehole bottom, which will then be disintegrated by the secondary cutter inserts 40 on the bottom of the grooves 32. The secondary cutter inserts 40 are preferably formed of tungsten carbide or another suitable hard material. The secondary cutter inserts 40 are preferably shaped to provide substantially hemispherical cutting surfaces, which are equivalent to the primary inserts 33, 34, 36 and 38 in strength and durability.

During drilling, the bit 10 is operated to conduct normal drilling operation so that the primary cutting elements 33, 34, 36 and 38 are maintained in crushing contact with portions of the surrounding borehole. The secondary cutting elements 40 are not in contact with the borehole. After a substantial amount of operation, the bit 10 will experience wear such that the primary cutting elements 33, 34, 36 and 38 will break down. The lands 35 on the cutter body 30 will then start to wear. At this point, the secondary cutting elements 40 are brought into crushing contact with portions of the borehole.

FIG. 3 depicts an alternative cutter 24' that is constructed in accordance with the present invention. The cutter 24' differs from the cutter 24 in that there are two grooves 50 and 52 rather than the single annular recess 32 provided with the first cutter element 24. Each of the two grooves 50, 52 contains a row of secondary cutting elements 60, which have a substantially planar cutting surface made of a polycrystalline diamond layer.

The invention is advantageous as it permits the drill bit to continue drilling after the primary cutting elements have been completely worn or destroyed. This will extend the useful life of a drill bit and allow it to complete a section of borehole without having to be replaced. Furthermore, it provides secondary cutting elements 40, 60 to disintegrate harmful formation build-ups generated in the offcenter running mode. The secondary cutting elements 40,60 are located inside the grooves 32 or 50 and 52 and do not typically come into cutting contact with the borehole during normal drilling.

While the invention has been described herein with respect to a preferred embodiment, it should be understood by those of skill in the art that it is not so limited. The invention is susceptible of various modifications and changes without departing from the scope of the claims.

What is claimed is:

1. A bit for use in drilling a borehole, the bit comprising:

a bit body;

a plurality of rolling cone cutters rotatably mounted on said bit body and having a cutter body;

a plurality of primary cutting elements on each rolling cone cutter, the primary cutting elements being disposed upon lands on the cutter body and projecting outwardly therefrom to engage portions of a borehole in cutting engagement; and at least one secondary cutting element disposed within grooves on the cutter body and not extending outwardly past the elevation of the lands, the secondary cutting element providing a reserve cutting structure after substantial wear to the bit.

2. The bit of claim 1 wherein the secondary cutting element provides an outer cutting surface that lies flush with a bottom of the groove.

3. The bit of claim 1 wherein the secondary cutting element provides an outer cutting surface that is recessed below a bottom of the groove.

4. The bit of claim 1 wherein the secondary cutting element presents an outer cutting surface that is substantially hemispherical.

5. The bit of claim 1 wherein the secondary cutting element presents an outer cutting surface that is substantially flat.

6. A rolling cone cutter for a three cone roller bit comprising:

a generally conical roller cutter body having an external surface;

a recessed groove within the roller cutter body, the groove having a bottom surface;

a plurality of primary cutting elements retained in a land on the roller cutter body and projecting outwardly from the external surface of the land; and a plurality of secondary cutting elements retained within the bottom surface of the groove of the roller cutter body, said secondary elements not projecting past the elevation of the land.

7. The rolling cone cutter of claim 6 wherein the secondary cutting elements are disposed in a row within the groove.

8. The rolling cone cutter of claim 6 wherein the secondary cutting elements present a substantially hemispherical outer cutting surface.

9. The rolling cone cutter of claim 7 wherein there is a plurality of said grooves.

10. The rolling cone cutter of claim 9 wherein the number of grooves is two.

11. The rolling cone cutter of claim 8 wherein the secondary cutting elements are substantially comprised of tungsten carbide.

12. The rolling cone cutter of claim 8 wherein the secondary cutting elements lie substantially flush with the bottom surface of the groove.

13. The rolling cone cutter of claim 8 wherein the secondary cutting elements lie recessed below the bottom of the grooves.

14. A method of drilling a borehole comprising:

disposing into a borehole a drill bit having a rolling cutter comprising:

1) a rolling cutter body;

2) a plurality of primary cutting elements that are retained within and extend outwardly from lands on the rolling cutter body; and 3) a plurality of secondary cutting elements that are retained within grooves on the rolling cutter body and do not extend outwardly past the lands when the cutter body is unworn;

engaging portions of a borehole with the primary cutting elements but not with the secondary cutting elements so as to cut borehole;

wearing the primary cutting elements and cutter body so that the primary cutting elements become substantially ineffective to cut borehole; and engaging portions of a borehole with the secondary cutting elements to continue to cut borehole.

* * * * *

UNITED STATES PATENT AND TRADEMARK OFFICE

CERTIFICATE OF CORRECTION

PATENT NO. : 6,601,661 B2 
DATED : August 5, 2003
INVENTOR(S) : Brian Andrew Baker et al.

It is certified that error appears in the above-identified patent and that said Letters Patent is hereby corrected as shown below:

Title page,
Item [75], Inventors, please correct the second inventor's name from "Brian Andrew Wiesner" to -- Brian Christopher Wiesner --.

Signed and Sealed this

Twenty-third Day of December, 2003

JAMES E. ROGAN
*Director of the United States Patent and Trademark Office*